US006735988B1

(12) United States Patent
Honeycutt

(10) Patent No.: US 6,735,988 B1
(45) Date of Patent: May 18, 2004

(54) COTTON FOOTIE AND STOCKING

(76) Inventor: Larry W. Honeycutt, P. O. Box 86, Concord, NC (US) 27026

( * ) Notice: Subject to any disclaimer, the term of this patent is extended or adjusted under 35 U.S.C. 154(b) by 148 days.

(21) Appl. No.: 10/107,603

(22) Filed: Mar. 27, 2002

(51) Int. Cl.[7] ..... D04B 9/46; A41B 11/02
(52) U.S. Cl. ..... 66/185; 2/239
(58) Field of Search ..... 66/178 R, 179, 66/180, 181, 182, 183, 184, 185, 186, 187, 188, 178 A; 2/239, 240, 241, 242

(56) References Cited

U.S. PATENT DOCUMENTS

| | | | | | |
|---|---|---|---|---|---|
| 2,144,563 | A | | 1/1939 | Davis | 66/182 |
| 2,333,373 | A | * | 11/1943 | Grey | 66/171 |
| 2,727,793 | A | | 12/1955 | Manger | 66/14 |
| 2,848,885 | A | * | 8/1958 | Goodman | 66/171 |
| 3,046,760 | A | | 7/1962 | Peberdy | 66/14 |
| 3,250,095 | A | | 5/1966 | Bird | 66/178 |
| 3,307,379 | A | | 3/1967 | Wooley et al. | 66/178 |
| 3,600,909 | A | * | 8/1971 | Kaplan | 66/171 |
| 3,733,860 | A | * | 5/1973 | Engelhard | 66/195 |
| 3,793,851 | A | | 2/1974 | Thorneburg | 66/185 |
| 4,073,163 | A | | 2/1978 | Lonait | 66/14 |
| 4,172,370 | A | | 10/1979 | Safrit et al. | 66/92 |
| 4,180,991 | A | | 1/1980 | Lonait | 66/14 |
| 4,194,249 | A | | 3/1980 | Thorenburg | 2/239 |
| 4,195,497 | A | | 4/1980 | Goldstein et al. | 66/185 |
| 4,233,822 | A | | 11/1980 | Lonati | 6/14 |
| 4,255,819 | A | | 3/1981 | Klingspor | 2/239 |
| 4,255,949 | A | | 3/1981 | Thorenburg | 66/185 |
| 4,263,793 | A | | 4/1981 | Safrit et al. | 66/185 |
| 4,269,044 | A | | 5/1981 | Lonati | 66/56 |
| 4,277,959 | A | | 7/1981 | Thorenburg | 66/182 |
| 4,339,932 | A | | 7/1982 | Lonati | 66/28 |
| 4,341,096 | A | | 7/1982 | Safrit et al. | 66/185 |
| 4,373,361 | A | | 2/1983 | Thorenburg | 66/178 |
| 4,454,729 | A | | 6/1984 | Lonati | 66/28 |
| 4,538,431 | A | | 9/1985 | Lonati | 66/224 |
| 4,615,188 | A | | 10/1986 | Hursh et al. | 66/196 |
| 4,718,253 | A | | 1/1988 | Lonati | 66/8 |
| 4,898,007 | A | | 2/1990 | Dahlgren | 66/185 |
| 4,954,398 | A | | 9/1990 | Bagrodia et al. | 428/400 |
| 5,056,339 | A | | 10/1991 | Lonati | 66/134 |
| 5,057,368 | A | | 10/1991 | Largman et al. | 428/397 |
| 5,353,524 | A | | 10/1994 | Brier | 36/55 |
| 5,463,882 | A | | 11/1995 | Yeh | 66/92 |
| 5,560,226 | A | | 10/1996 | Throneburg | 66/185 |
| 5,603,232 | A | * | 2/1997 | Throneburg | 66/185 |
| 5,724,836 | A | | 3/1998 | Green | 66/185 |
| 5,765,401 | A | | 6/1998 | Ives et al. | 6/203 |
| 5,926,852 | A | | 7/1999 | Hudy | 2/239 |
| 5,972,505 | A | | 10/1999 | Phillips et al. | 428/397 |
| 6,023,949 | A | | 2/2000 | Lonati et al. | 66/153 |
| 6,082,145 | A | | 7/2000 | Lonati et al. | 6/176 |
| 6,089,048 | A | | 7/2000 | Lonati et al. | 66/134 |
| 6,092,491 | A | | 7/2000 | Dugan et al. | 428/397 |

(List continued on next page.)

OTHER PUBLICATIONS

Article entitled "Technical Brochure for Hosiery" from Dorlastan Bayer Spandex; undated.

Textile Processing vol. II, published by the State Dept. of Education, Columbia, SC, copyright 1997.

*Primary Examiner*—Danny Worrell
(74) *Attorney, Agent, or Firm*—MacCord Mason PLLC

(57) ABSTRACT

A knitted article that includes a top portion, a bottom portion and a seam is disclosed. The top portion has a cross stretch less than about 12. The bottom portion may be formed from a lock stitch and may have a cross stretch greater than about 12. Also in the bottom portion, at least one yarn end may be different from the yarn forming the top portion. The seam extends substantially from the toe of the bottom portion to the heel of the bottom portion, thereby forming the sides and sole of said knitted article. An insert board may be included for forming a package.

81 Claims, 11 Drawing Sheets

U.S. PATENT DOCUMENTS 6,094,945 A 8/2000 Lonati et al. ..... 66/146
6,103,376 A 8/2000 Phillips et al. ..... 428/397
6,122,939 A 9/2000 Lonati et al. ..... 66/145
6,125,665 A 10/2000 Lonati et al. ..... 66/183
6,164,090 A 12/2000 Lonati et al. ..... 66/57
6,164,094 A 12/2000 Lonati et al. ..... 66/172
6,173,589 B1 * 1/2001 Hayes et al. ..... 66/171
6,176,106 B1 1/2001 Lonati et al. ..... 66/95
6,223,564 B1 5/2001 Lonati et al. ..... 2/239
6,286,151 B1 9/2001 Lambertz ..... 2/239
6,336,227 B1 * 1/2002 Liput et al. ..... 2/239
6,352,774 B1 3/2002 Phillips et al. ..... 428/397
6,415,632 B1 * 7/2002 Vesnaver ..... 66/19
6,457,332 B1 * 10/2002 Schiavello ..... 66/8

* cited by examiner

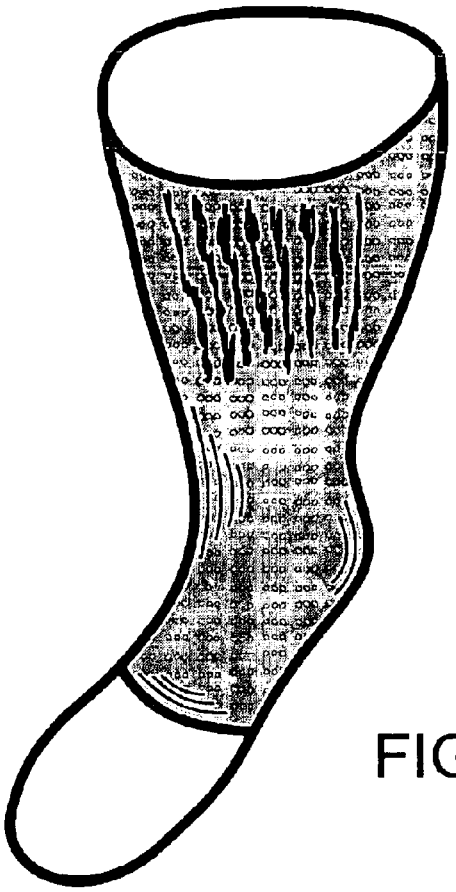
FIG. 3A
FIG. 3B
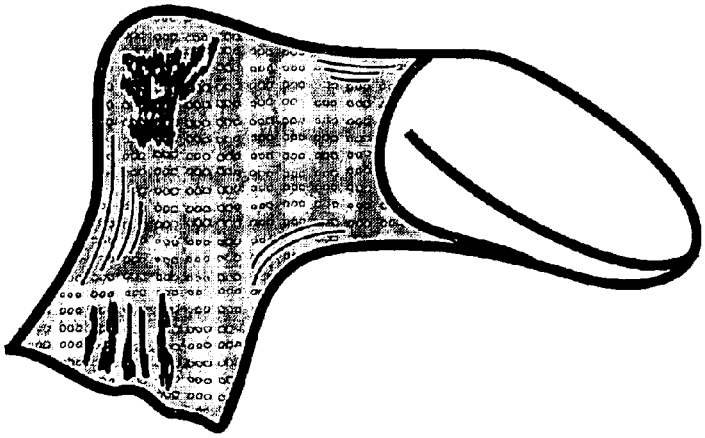

COTTON FOOTIE AND STOCKING

BACKGROUND OF THE INVENTION (1) Field of the Invention

The present invention relates generally to knitted articles and, more particularly, to a knitted article having a seam extending substantially from the toe of the bottom portion to the heel of the bottom portion, thereby forming the sides and sole of the knitted article and a package for displaying the knitted article.

(2) Description of the Prior Art

A conventional knee-high stocking including a cotton toe is schematically depicted in FIGS. 3A and 3B. For such a stocking, the body is made using a 15½ cross stretch, the ankle is made using an 11 cross stretch, and the toe is made using a 9½ cross stretch. If made using a Lonati L301 4 end X 342 needle single-cylinder knitter, the top of the body might be made using 4 ends of 40 denier yarn and the remainder of the body, the ankle and the toe, may be made using 4 ends of 20/7 denier yarn. Below the ankle, a heel portion is included to accommodate a wearer's foot, and then about halfway to the toe, some or all of the ends are changed over to cotton. At the toe, a 1×1 lock stitch may be used so that the wearer's toes will not protrude through the end of the sock. The toe is then sewn shut. Although the foot may be surrounded with cotton yarns, the change in stitch can be aesthetically problematic.

Conventional hosiery is made using a knit tube section using conventional and elastic threads. The elastic threads help the hosiery to stretch for better fit to conform to the leg, added comfort and better looks. Spandex is the generic term for the elastic threads. Lycra® is a well-known brand of spandex from E. I du Pont du Nemours and Company.

For high hosiery as schematically depicted in FIGS. 4A and 4B, the body is made using a 15½ cross stretch, the ankle is made using an 11 cross stretch, and the toe is made using a 9½ cross stretch. When made using a Lonati L301 4 end X 342 needle single-cylinder knitter, the top of the body is made using 4 ends of 40 denier yarn and the remainder of the body is made using 4 ends of 20/7 denier yarn. The ankle and the toe are also made using 4 ends of 20/7 denier yarn. The toe looks different even when using the 20/7 denier yarn because the stitch formation is changed to a 1×1 lock stitch. The toe is then sewn shut. The use of the 1×1 lock stitch ensures that ladies' toes will not protrude through the end of the hosiery.

For convention knee-high hosiery including a laid in cotton bottom, as schematically depicted in FIGS. 5A and 5B, the same construction is used. That is, the body made using a 15½ cross stretch, the ankle is made using an 11 cross stretch, and the toe is made using a 9½ cross stretch. Also, when made using a Lonati L301 4 end X 342 needle single-cylinder knitter, the top of the body is made using 4 ends of 40 denier yarn and the remainder of the body, the ankle, and the toe are made using 4 ends of 20/7 denier yarn. As above, the toe is then sewn shut and the use of the 1×1 lock stitch ensures that ladies' toes will not protrude through the end of the hosiery. The change occurs below the ankle part at the foot part. Here, a cotton bottom is striped in (a.k.a. inlaid) every revolution during the formation of the tube. Thus, a knife cuts the yarns every time the portion of the tube that is to become the bottom comes around. The ends of the yarns become frayed along the edges of the inlaid cotton portion creating a raggedy look that is not presentable for the marketplace. Also, the entire bottom and the side cannot be inlaid with cotton yarn.

For a disposable foot sock, as schematically depicted in FIGS. 6A and 6B, the construction is a body made using a 15–14½ cross stretch. Also, when made using a Lonati L301 4 end X 342 needle single-cylinder knitter, the top of the body is made using 4 ends of 40 denier yarn and the remainder is made using 4 ends of 20/7 denier yarn in a 1×1 alternate lock stitch. A seam from the toe to the heal at the bottom is used to close the foot sock. Such a foot sock is suitable for a limited number of uses-more typically only one.

Thus, there remains a need for new and improved knitted articles and, more particularly, to a knitted article having a seam extending substantially from the toe of the bottom portion to the heel of the bottom portion, thereby forming the sides and sole of the knitted article and a package for displaying the knitted article.

SUMMARY OF THE INVENTION

The present invention is directed to a knitted article. The article includes a top portion, a bottom portion and a seam. The top portion has a cross stretch less than about 12. The bottom portion may be formed from a lock stitch and may have a cross stretch greater than about 12. Also in the bottom portion, at least one yarn end may be different from the yarn forming the top portion. The seam extends substantially from the toe of the bottom portion to the heel of the bottom portion, thereby forming the sides and sole of the knitted article. An insert board may be included for forming a package.

The insert board may include a foot portion and a top portion. The package may further include a band for binding the knitted article and a hanger, such as a sock hanger.

The package may be a package cover and a hanger may be formed from the package cover. Also, the package may be a package cover that may include a see-through window. The window may be foot-shaped.

The top portion is formed from a textured yarn, such as nylon. The textured yarn may be greater than about 10 denier, such as a 20/7. Preferably, the textured yarn may be greater than about 40 denier, such as a 40/13.

The knitted article is formed from at least 2 ends and may be formed from at least 4 ends. The knitted article may include leg portions. Also, the knitted article may include a panty.

The at least one yarn end different from the yarn forming the top portion may be functionally different. For example, the different yarn may be hydrophilic, such as cotton. When used, the cotton yarn may be a 50/1.

The at least one yarn end different from the yarn forming the top portion may be functionally different, such as moisture transporting. A moisture transporting yarn may be olefin based, such as, for example, polypropylene based, polyethylene based, and combinations thereof; polyethylene oxide based; and polyester based fiber. When using a polypropylene based yarn, it may be any of 30/12, 40/20 or 60/20. A 40/20 polypropylene yarn from Filament Fiber Technology, Inc. (FFT), Salisbury, N.C. has been found to work satisfactorily. Fiber Innovation Technology, Inc. of Johnson City, Tenn. (having an internet address at http://www.fitfibers.com) the subject matter of which is herein incorporated by reference in its entirety, produces synthetic fibers for use in moisture transport applications. U.S. Pat. Nos. 6,352,774; 6,103,376; 6,103,376; 6,093,491; 5,972,505; 5,057,368; and 4,954,398 disclose compositions and structures that are useful for moisture transport applications, the subject matter of each being incorporated herein by reference in its entirety.

The yarn-to-yarn ratio between at least one yarn end different from the yarn forming the top portion may be between about 20/80 and 80/20, preferably between about 40/60 and 60/40, and, more preferably, about 50/50.

At least one yarn end different from the yarn forming the top portion may be any one: (a) about one yarn out of three being different, (b) about two yarns out of three being different, (c) about two yarns out of four being different, and (d) about three yarns out of four being different.

At least one yarn end different from the yarn forming the top portion may be finished with the same color. Alternatively, at least one yarn end different from the yarn forming the top portion may be finished with different colors.

The lock stitch may be a one-by-one alternating stitch.

The sides and sole of the knitted article may be substantially hidden when the knitted article is worn with footwear.

The knitted article may include a transition zone between the top portion and the bottom portion. The transition zone may be formed from the same yarn as the top portion.

Accordingly, one aspect of the present invention is to provide a knitted article. The article includes a top portion, a bottom portion and a seam. The top portion has a cross stretch less than about 12. The bottom portion is formed from a cross stretch greater than about 12. Also in the bottom portion, at least one yarn end is different from the yarn forming the top portion. The seam extends substantially from the toe of the bottom portion to the heel of the bottom portion, thereby forming the sides and sole of the knitted article.

Another aspect of the present invention is to provide a knitted article. The article includes a top portion, a bottom portion and a seam. The top portion has a cross stretch less than about 12. The bottom portion is formed from a lock stitch and has a cross stretch greater than about 12. Also in the bottom portion, at least one yarn end is different from the yarn forming the top portion. The seam extends substantially from the toe of the bottom portion to the heel of the bottom portion, thereby forming the sides and sole of the knitted article.

Still another aspect of the present invention is to provide a knitted article. The article includes a top portion, a bottom portion and a seam. The top portion has a cross stretch less than about 12. The bottom portion is formed from a lock stitch and has a cross stretch greater than about 12. Also in the bottom portion, at least one yarn end is different from the yarn forming the top portion. The seam extends substantially from the toe of the bottom portion to the heel of the bottom portion, thereby forming the sides and sole of the knitted article. An insert board is included for forming a package.

These and other aspects of the present invention will become apparent to those skilled in the art after a reading of the following description of the preferred embodiment when considered with the drawings.

BRIEF DESCRIPTION OF THE DRAWINGS

FIG. 3A is a knitted sock according to the prior art;

FIG. 3B is a bottom view of the sock of FIG. 3A;

DESCRIPTION OF THE PREFERRED EMBODIMENTS

Figures 1A, 1B:
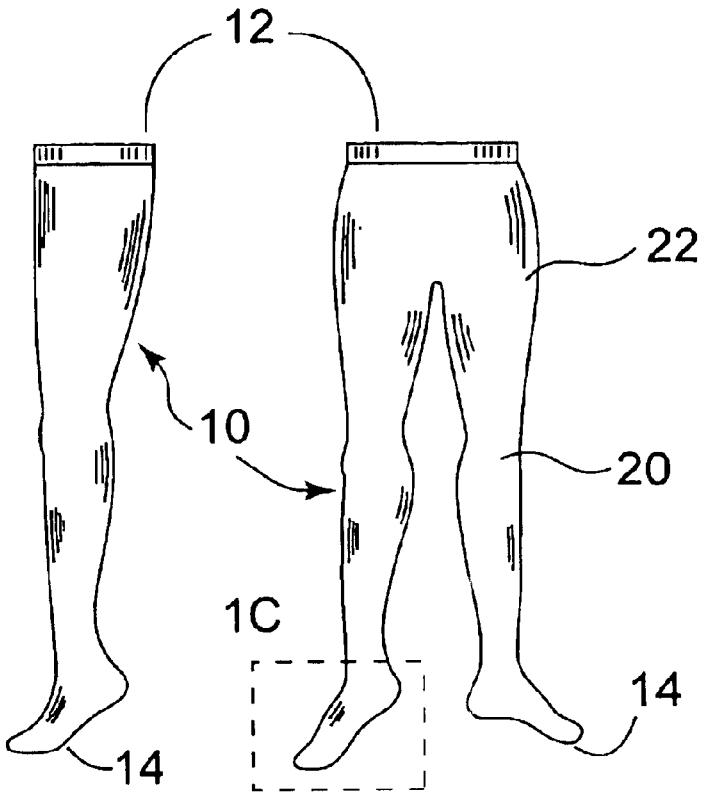
FIG. 1A is a side view of a knitted article according to an embodiment of the present invention.
FIG. 1B is a front view of the knitted article of FIG. 1A.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 1C:
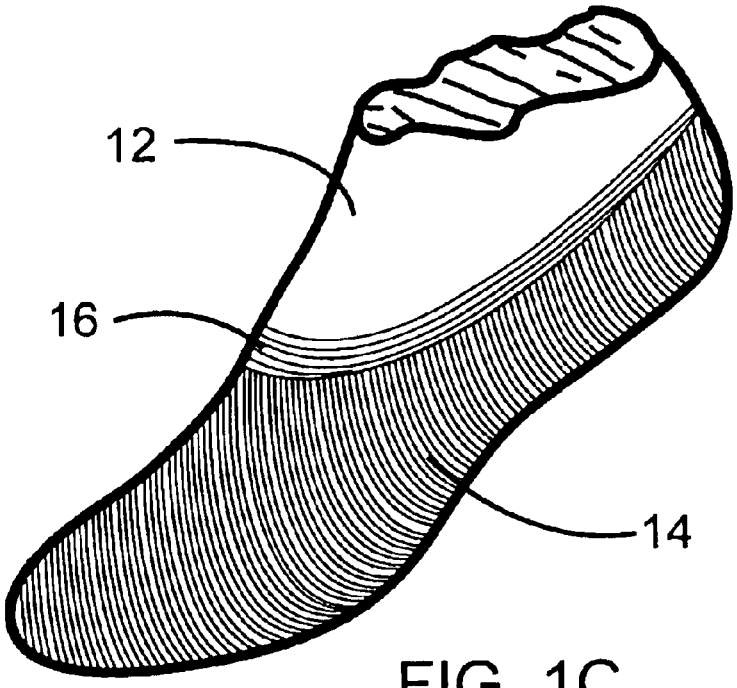
FIG. 1C is an enlargement of a foot portion of the knitted article of FIG. 1B.

Referring now to the drawings in general and FIGS. 1A, 1B, 1C, 2A, 2B, 7, 8, 10 and 11 in particular, it will be understood that the illustrations are for the purpose of describing a preferred embodiment of the invention and are not intended to limit the invention thereto. As best seen in FIGS. 1A, 1B, 2A and 2B a knitted article, generally designated 10, is shown constructed according to the present invention. The knitted article 10 includes a top portion 12 and a bottom portion 14. As best seen in FIG. 1C, there may be a transition zone 16 between the top portion 12 and the bottom portion 14. As best seen in seen in FIGS. 1A and 1B, a knitted article 10 may include a leg portion 20 as well as a panty 22.

Figures 2A, 2B:
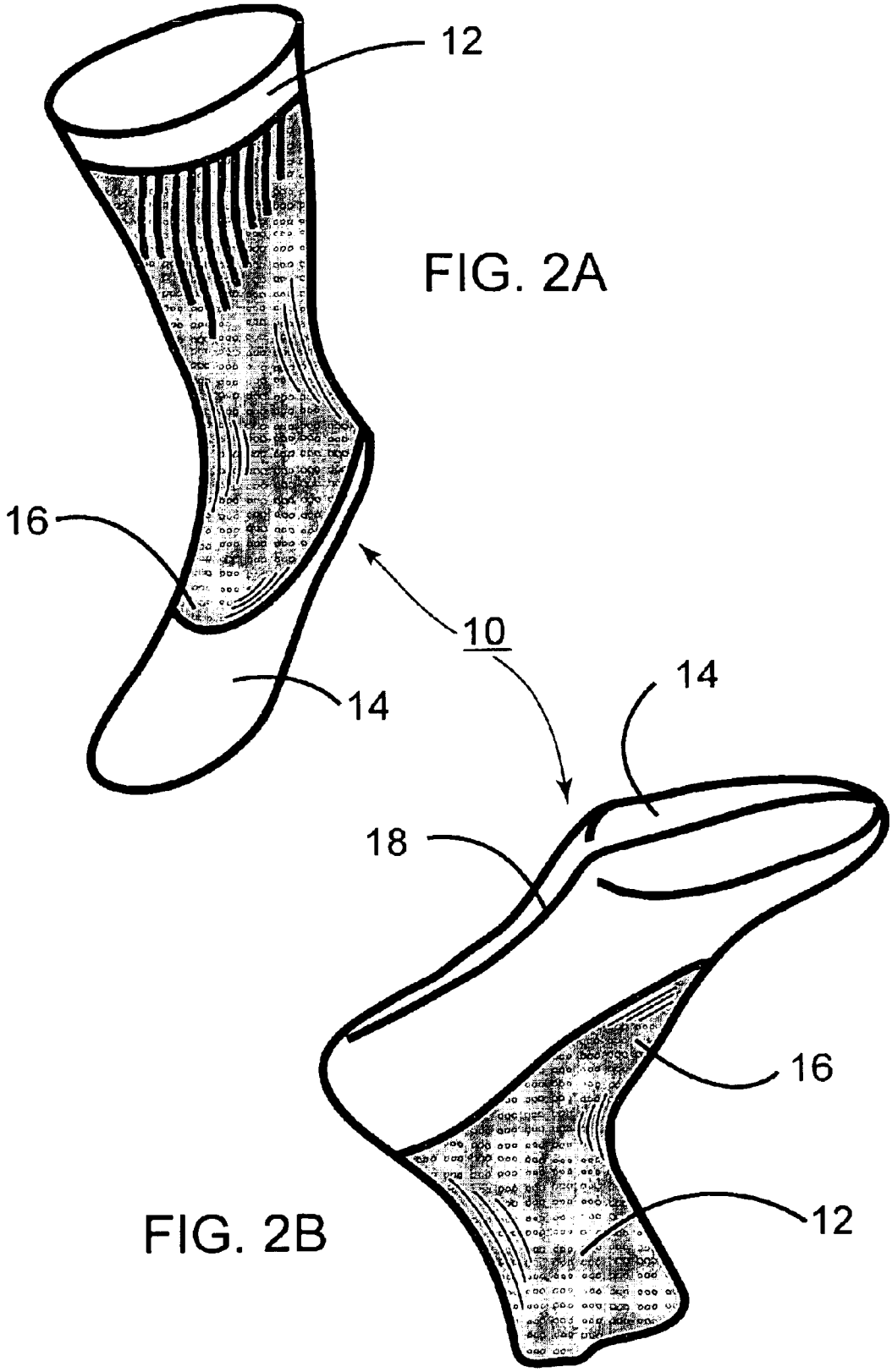
FIG. 2A is an isometric schematic of a knitted article according to the present invention.
FIG. 2B is a bottom view of the knitted article of FIG. 2B.
Figure 4A:
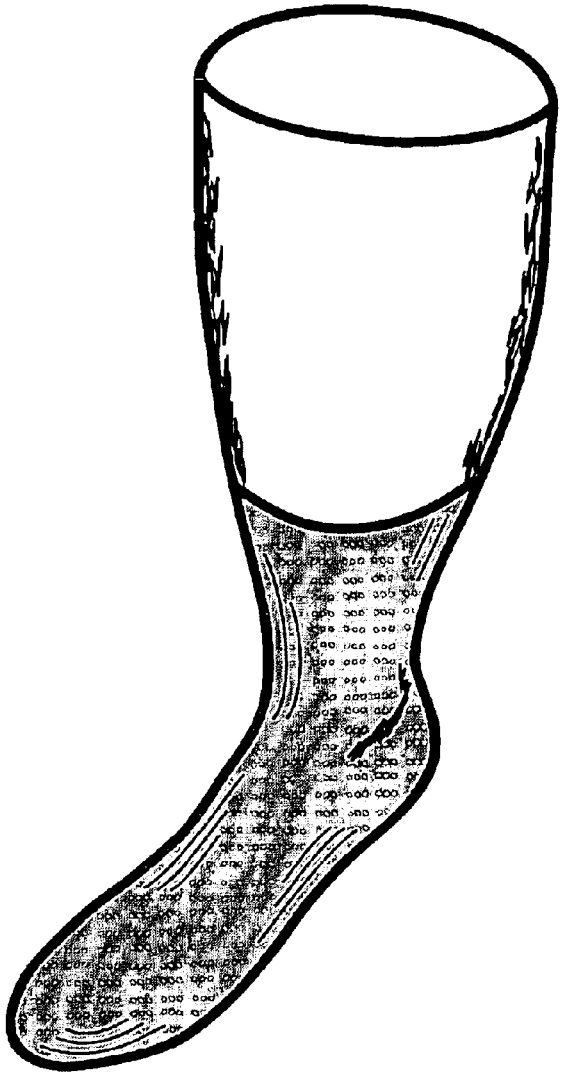
PRIOR ART FIG. 4A
FIG. 4A is knitted hosiery of the prior art.
Figure 4B:
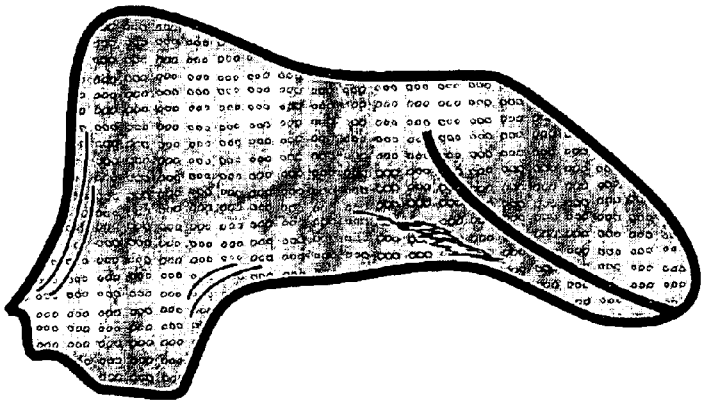
FIG. 4B is a bottom view of the knitted hosiery of FIG. 4A.
Figure 5A:
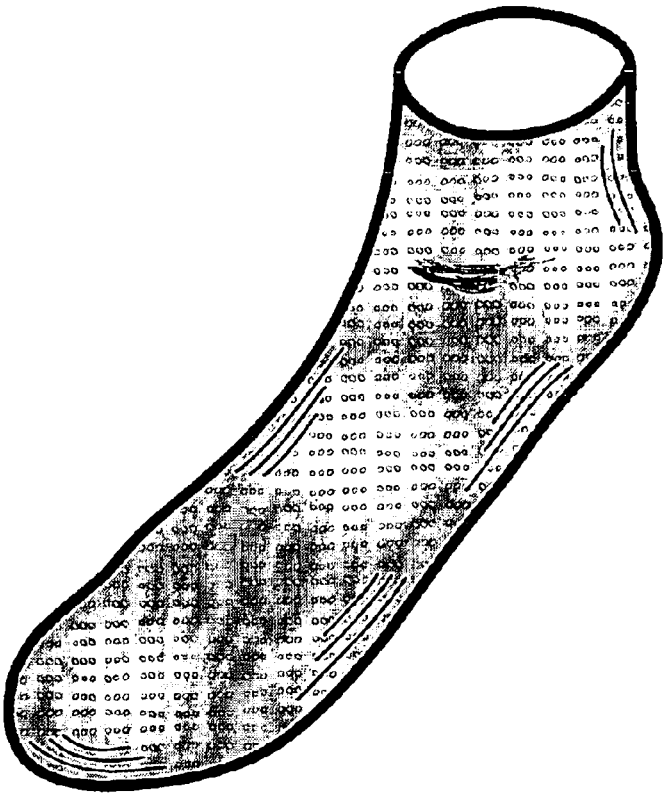
PRIOR ART FIG. 5A
FIG. 5A is knitted hosiery of the prior art including a cotton swatch.
Figure 5B:
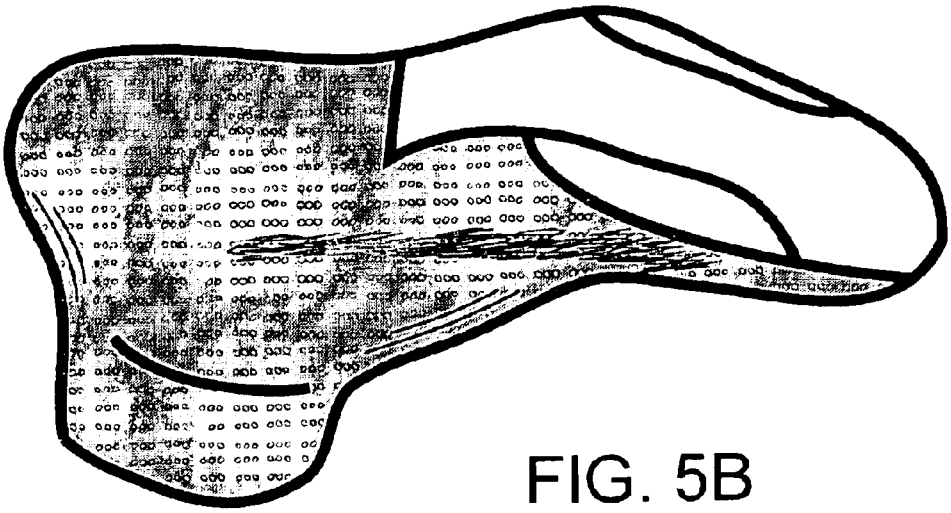
FIG. 5B is a bottom view of the knitted hosiery of FIG. 5B emphasizing the inlaid cotton in the bottom.

However, as best seen in FIGS. 2A and 2B, a knitted article 10 need not have either a leg portion 20, nor a leg portion 20 and a panty portion 22. In particular, FIG. 2A shows that that the top portion 12 may merely raise up to the calf. Applicant contemplates the top portion 12 may likewise merely raise to the ankle, just above the ankle and just below the ankle. In any case, a knitted article 10 includes a top portion 12, a bottom 14, and may include a transition zone 16, as can be seen in FIG. 1C.

FIG. 2B shows that the knitted article 10 includes a seam 18. The seam extends substantially from the toe of the bottom portion 14 to the heel of the bottom portion 14. In this manner, the sides and sole of the knitted article 10 are formed.

A knitted article 10 according to the present invention is differentiated from the prior art, as is shown in FIGS. 3A, 3B, 4A, 4B, 5A, 5B, 6A and 6B. Each figure contains an illustration of an isometric view of a prior art article and a corresponding bottom view of the article. Some details relating to such articles may be found in U.S. Pat. Nos. 2,144,563; 3,250,095; 3,307,379; 3,793,851; 4,172,370; 4,194,249; 4,195,497; 4,255,819; 4,255,949; 4,263,793; 4,277,959; 4,341,096; 4,373,361; 4,615,188; 5,560,226; 5,765,401; 4,898,007; 5,353,524; 5,463,882; 5,724,836; 5,926,852; and 6,286,151, the subject matter of each being incorporated herein by reference in its entirety.

A knitted article of the present invention is schematically depicted in FIGS. 2A and 2B. For such a knitted article 10, the top portion 12 is made using an about 15½ cross stretch, the ankle portion is made using an about 11½ cross stretch and the button potion 14 is made using an about 15½ to 16½ cross stretch. The top of the top portion 12 may be made using 4 ends of about 40 denier yarn and the remainder of the top portion 12 and the ankle portion may be made using 4 ends of 20/7 denier yarn. In the bottom portion 14, some of the ends may be changed over to cotton and the stitch may be changed over to a 1×1 lock stitch. The bottom portion is sewn shut such that the seam extends substantially from the toe of the bottom portion to the heel of the bottom portion. In this manner, the sides and sole of the knitted article are formed. A particular advantage of this configuration is that a wearer's foot may be surrounded by cotton to wick perspiration away. Additionally, as best seen in FIG. 1C, the result is aesthetically pleasing. Moreover, the side may be easily hidden by a wearer's footwear.

Figure 10:
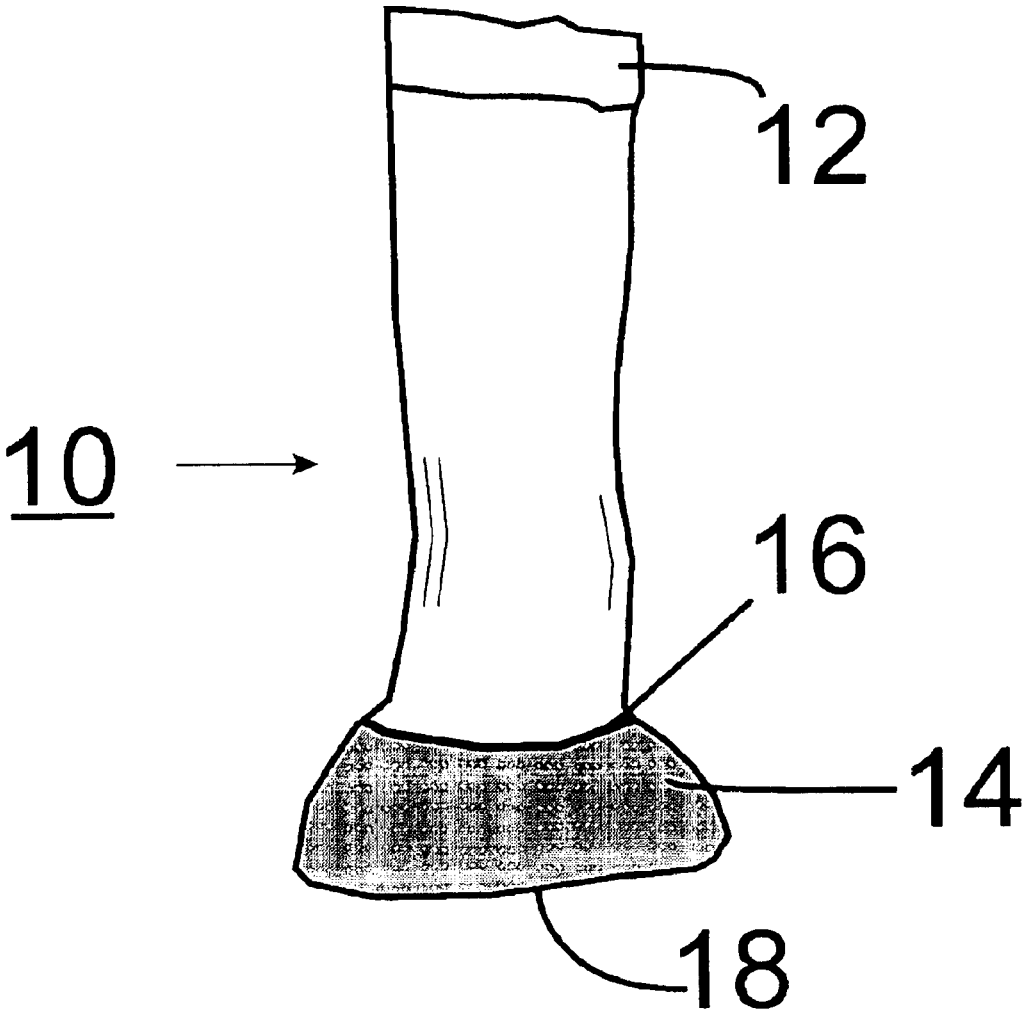
FIG. 10 is a knitted article according to the present invention displayed as it appears after formation.

As beat seen in FIG. 10, when not worn, a knitted article 10 according to the present invention can appear amorphous. Thus, it may be desirable to display such an article on an insert 30 for packaging, such as that shown in FIG. 7. The insert 30 may include a top portion 34 and a foot portion 36. In this manner, a knitted article 10 may be displayed as shown, for example, in FIG. 8. A plurality of knitted articles 10 may be displayed together through the use of a band 50. Additionally, a hook 52 may be added for conveniently displaying the banned knitted articles 10 on a rack in a store.

Figure 6A:
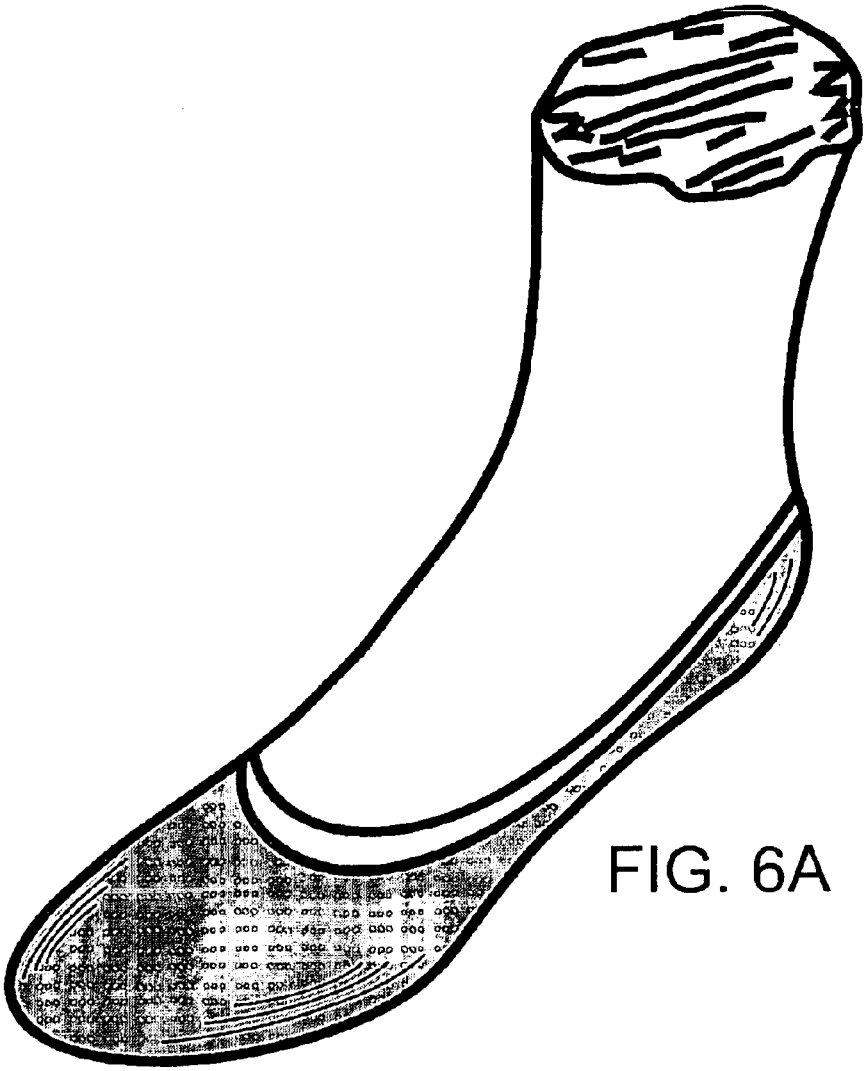
FIG. 6A is a knitted foot sock of the prior art.
Figure 6B:
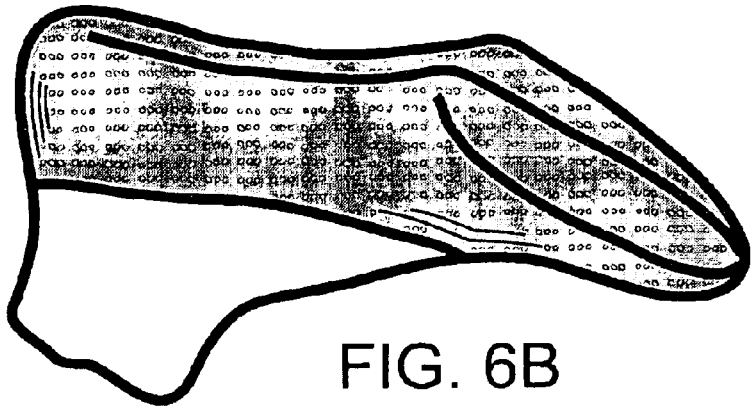
FIG. 6B is a bottom view of the knitted foot sock according to the prior art.
Figure 7:
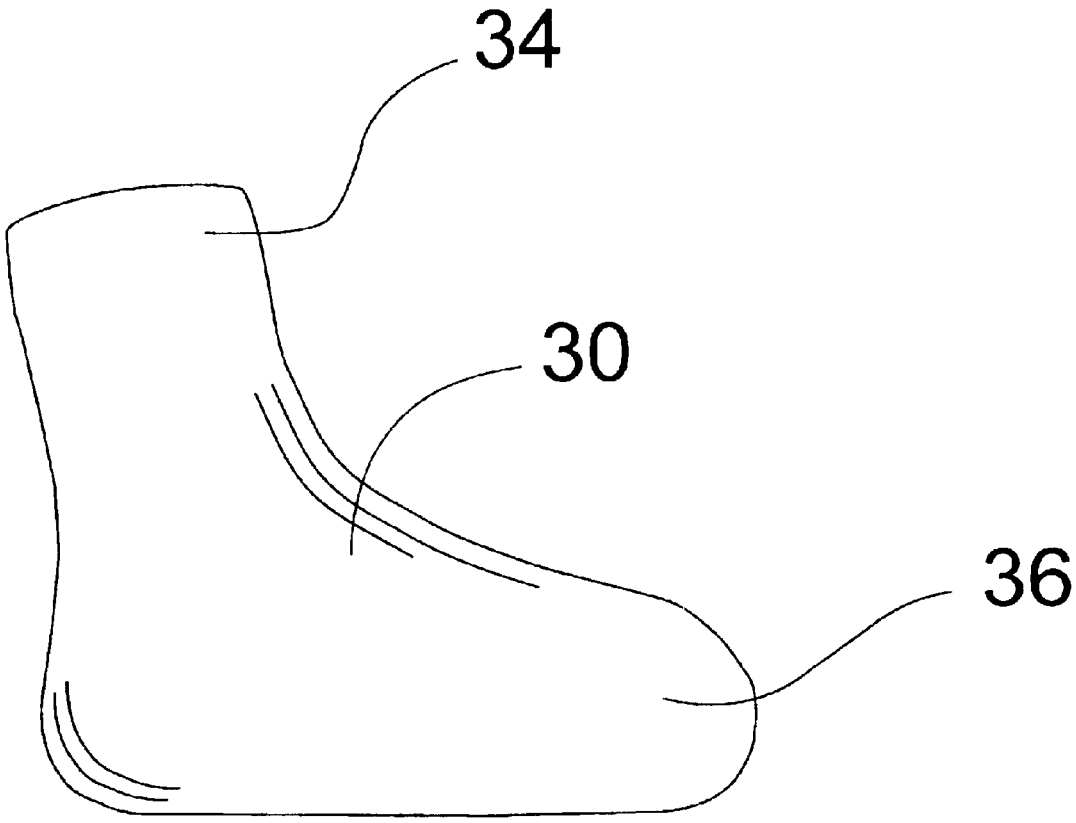
FIG. 7 is an insert board for forming a package according to an embodiment of the present invention.
Figure 8:
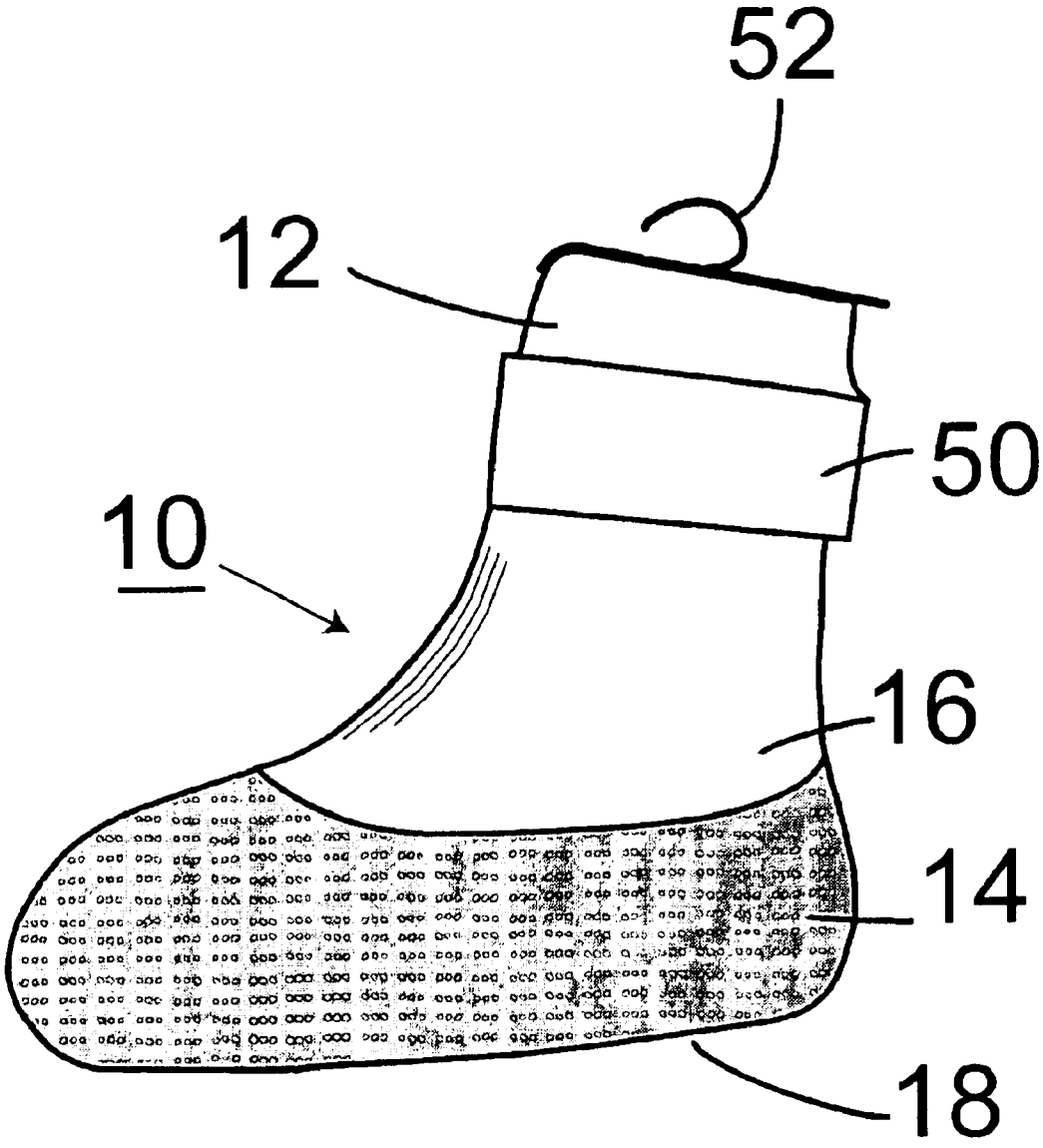
FIG. 8 is a knitted article according to the present invention on the insert board of FIG. 7.
Figure 9A:
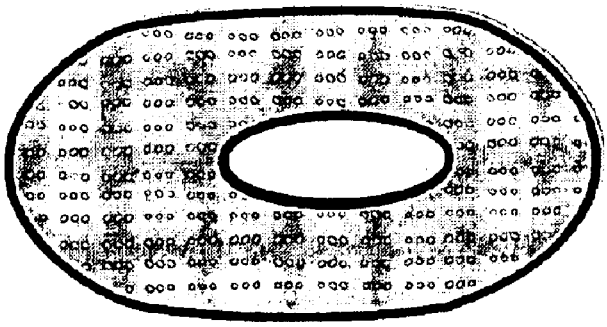
FIG. 9A is an insert board of the prior art for a foot sock.
Figure 9B:
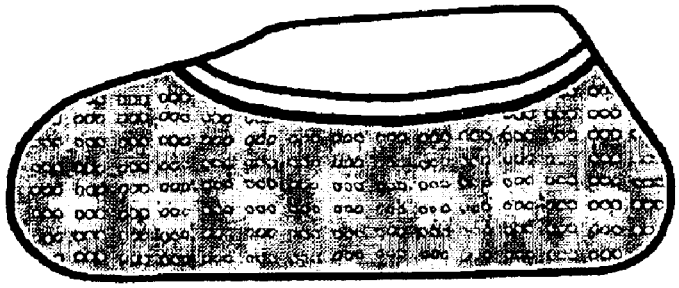
FIG. 9B is an alternative insert board of the prior art for a foot sock.

FIGS. 9A and 9B are provided for comparing the prior art displays for foot socks of FIGS. 6A and 6B to the present novel and improved display package.

Figure 11:
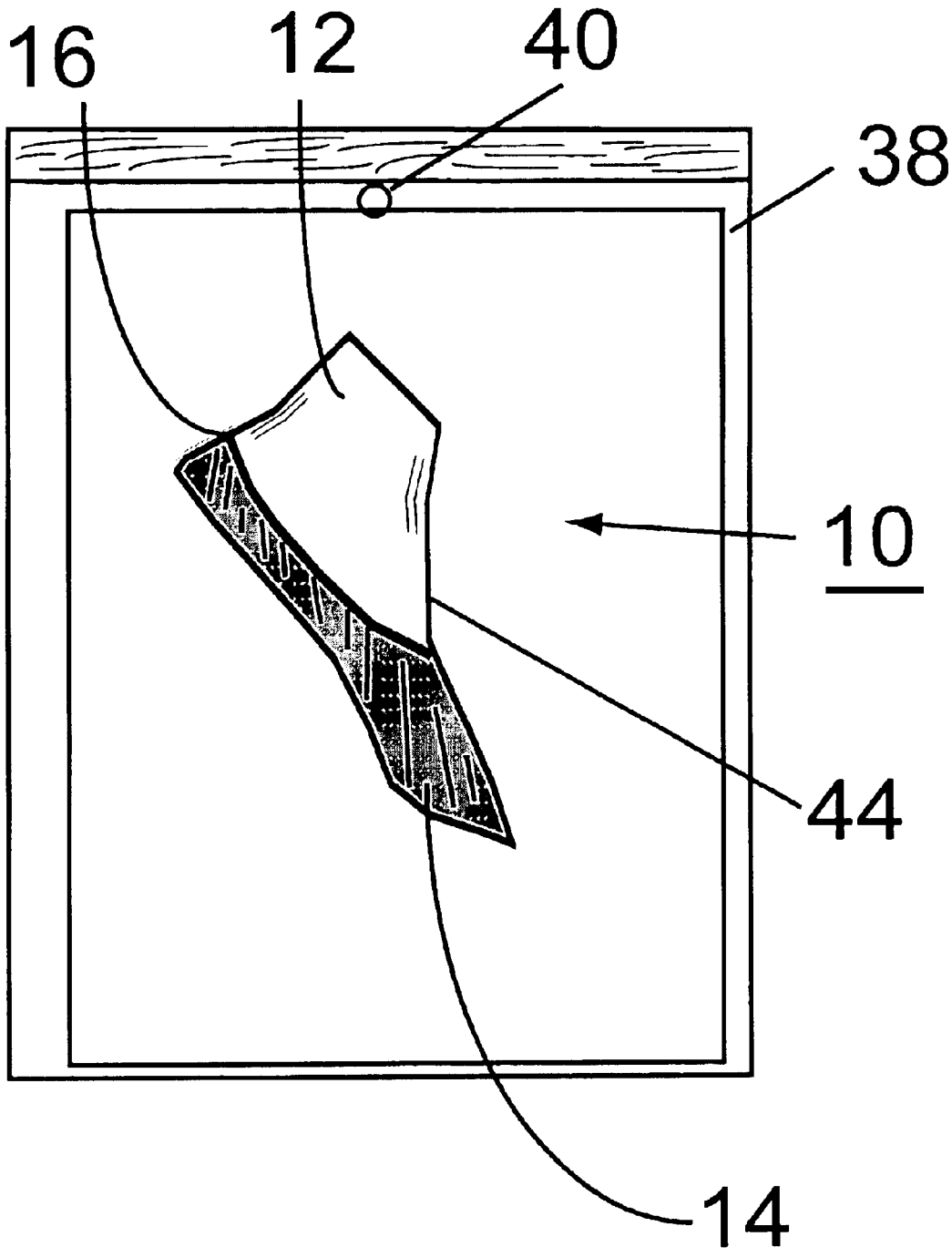
FIG. 11 is a package for displaying a knitted article according to the present invention.

Another display package for the knitted article 10 according to the present invention is shown in FIG. 11. In FIG. 11, a package 38 includes a hanger 40. The package 30 may include a window 44 which might be foot-shaped to accentuate the aspects of the top portion 12 and bottom portion 14 of a knitted article 10.

In operation, a knitted article 10 may be made using a Lonati L301 4 end X 342 needle single-cylinder knitter. Aspect of such knitters may be found in U.S. Pat. Nos. 2,737,793; 3,046,760; 3,307,379; 4,073,163; 4,180,911; 4,233,822; 4,269,044; 4,339,932; 4,454,729; 4,538,431; 4,718,253; 5,056,339; 6,223,564; 6,176,106; 6,164,094; 6,164,090; 6,125,665; 6,122,939; 6,094,945; 6,089,048; 6,082,145; and 6,023,949, the subject matter of each being incorporated herein by reference in its entirety. The top of the top portion 12 may be made using 4 ends of about 40 denier yarn and the remainder of the top portion 12 and the ankle portion may be made using 4 ends of 20/7 denier yarn. In the bottom portion 14, some of the ends may be changed over to cotton and the stitch may be changed over to a 1×1 lock stitch. The bottom portion is sewn shut such that the seam extends substantially from the toe of the bottom portion to the heel of the bottom portion. In this manner, the sides and sole of the knitted article are formed.

Applicant contemplates that a variety of stitch patterns and fibers may be used to accomplish the present invention. To that end, those skilled in the art will appreciate that the aspects of the above-referenced patents may be used to accomplish the structure-function relationships of the present invention. Additionally, those skilled in the art will appreciate that the aspects of "*Knitting Technology: A Comprehensive Handbook and Practical Guide, Third Edition*" written by David I. Spencer (Publication Date: May 7, 2001 ISBN: 1587161214), its subject matter being incorporated herein by reference in its entirety, may be used to accomplish the structure-function relationships of the present invention.

As noted above, at least one yarn end may be different from the yarn forming the top portion. This different yarn may be functionally different, such as moisture transporting. Moisture transporting yarn may be any one of olefin based such as for example polypropylene based, polyethylene based, and combinations thereof; polyethylene oxide based; and polyester based fiber. When using a polypropylene based yarn, it may be any of 30/12, 40/20; and 60/20. A 40/20 polypropylene yarn from Filament Fiber Technology, Inc. (FFT), Salisbury, N.C. has been found to work satisfactorily.

Applicant contemplates that a variety of moisture transporting yarn composition may be used. Fiber Innovation Technology, Inc. of Johnson City, Tenn. (having an internet address at http://www.fitfibers.com the subject matter of which is herein incorporated by reference in its entirety) produces synthetic fibers for use in moisture transport applications. U.S. Pat. Nos. 6,352,774; 6,103,376; 6,103,376; 6,093,491; 5,972,505; 5,057,368; and 4,954,398 disclose compositions and structures that that are useful for moisture transport applications, the subject matter of each being incorporated herein by reference in its entirety.

Certain modifications and improvements will occur to those skilled in the art upon a reading of the foregoing description. By way of example, a pattern/logo or yarns (for example Lurex® yarn) may be introduced to enhance the appearance of the top or bottom, or both, of a knitted garment. Also, a reciprocated garment may be redefined to accept a seam across the bottom. It should be understood that all such modifications and improvements have been deleted herein for the sake of conciseness and readability but are properly within the scope of the following claims.

I claim:

1. A knitted article, said article comprising:

(a) a top portion having cross stretch less than about 12;

(b) a bottom portion having a cross stretch greater than about 12 and at least one yarn end different from the yarn forming said top portion; and (c) a seam extending substantially from the toe of said bottom portion to the heel of said bottom portion, thereby forming the sides and sole of said knitted article.

2. The knitted article according to claim 1, further including an insert board for forming a package.

3. The knitted article according to claim 2, wherein said insert board includes a foot portion and a top portion.

4. The knitted article according to claim 2, wherein said package further includes a band for binding said knitted article.

5. The knitted article according to claim 2, wherein said package further includes a hanger.

6. The knitted article according to claim 5, wherein the hanger means is a sock hanger.

7. The knitted article according to claim 2, wherein said package is a package cover and a hanger is formed from said package cover.

8. The knitted article according to claim 2, wherein said package is a package cover and said package cover further includes a see through window.

9. The knitted article according to claim 8, wherein said window is foot shaped.

10. A knitted article, said article comprising:

(a) a top portion having cross stretch less than about 12;

(b) a bottom portion formed from a lock stitch and having a cross stretch greater than about 12 and at least one yarn end different from the yarn forming said top portion; and (c) a seam extending substantially from the toe of said bottom portion to the heel of said bottom portion, thereby forming the sides and sole of said knitted article.

11. The knitted article according to claim 10, wherein said top portion is formed from a textured yarn.

12. The knitted article according to claim 11, wherein said textured yarn is nylon.

13. The knitted article according to claim 11, wherein said yarn is greater than about 10 denier.

14. The knitted article according to claim 13, wherein said yarn is a 20/7.

15. The knitted article according to claim 13, wherein said yarn is about 40 denier.

16. The knitted article according to claim 15, wherein said yarn is a 40/13.

17. The knitted article according to claim 10, wherein said knitted article is formed from at least 2 ends.

18. The knitted article according to claim 17, wherein said knitted article is formed from at least 4 ends.

19. The knitted article according to claim 10, wherein said knitted article further includes leg portions.

20. The knitted article according to claim 19, wherein said knitted article further includes a panty.

21. The knitted article according to claim 10, wherein said at least one yarn end different from the yarn forming said top portion is functionally different.

22. The knitted article according to claim 21, wherein said different yarn is hydrophilic.

23. The knitted article according to claim 22, wherein said hydrophilic yarn is cotton.

24. The knitted article according to claim 23, wherein said cotton yarn is a 50/1.

25. The knitted article according to claim 21, wherein said different yarn is moisture transporting.

26. The knitted article according to claim 25, wherein said moisture transporting yarn is any one of olefin based, polyethylene oxide based, and polyester based.

27. The knitted article according to claim 26, wherein said moisture transporting yarn is 040/020 polypropylene based yarn.

28. The knitted article according to claim 10, wherein the yarn to yarn ratio between said at least one yarn end different from the yarn forming said top portion is between about 20/80 and 80/20.

29. The knitted article according to claim 28, wherein the yarn to yarn ratio is between about 40/60 and 60/40.

30. The knitted article according to claim 29, wherein the yarn to yarn ratio is about 50/50.

31. The knitted article according to claim 10, wherein about one yarn out of three is different.

32. The knitted article according to claim 10, wherein about two yarns out of three are different.

33. The knitted article according to claim 10, wherein about two yarns out of four are different.

34. The knitted article according to claim 10, wherein about three yarns out of four are different.

35. The knitted article according to claim 10, wherein said at least one yarn end different from the yarn forming said top portion are finished with the same color.

36. The knitted article according to claim 10, wherein said at least one yarn end different from the yarn forming said top portion are finished with different colors.

37. The knitted article according to claim 10, wherein said lock stitch is a one-by-one alternating stitch.

38. The knitted article according to claim 10, wherein the sides and sole of said knitted article are substantially hidden when worn with footwear.

39. The knitted article according to claim 10, further including a transition zone between said top portion and said bottom portion.

40. The knitted article according to claim 39, wherein said transition zone is formed from the same yarn as the top portion.

41. A knitted article, said article comprising:

(a) a top portion having cross stretch less than about 12;

(b) a bottom portion formed from a lock stitch and having a cross stretch greater than about 12 and at least one yarn end different from the yarn forming said top portion;

(c) a seam extending substantially from the toe of said bottom portion to the heel of said bottom portion, thereby forming the sides and sole of said knitted article; and.

(d) an insert board for forming a package.

42. The knitted article according to claim 41, wherein said insert board includes a foot portion and a top portion.

43. The knitted article according to claim 41, wherein said package further includes a band for binding said knitted article.

44. The knitted article according to claim 41, wherein said package further includes a hanger.

45. The knitted article according to claim 44, wherein the hanger means is a sock hanger.

46. The knitted article according to claim 41, wherein said package is a package cover and a hanger is formed from said package cover.

47. The knitted article according to claim 41, wherein said package is a package cover and said package cover further includes a see through window.

48. The knitted article according to claim 47, wherein said window is foot shaped.

49. The knitted article according to claim 41, wherein said top portion is formed from a textured yarn.

50. The knitted article according to claim 49, wherein said textured yarn is nylon.

51. The knitted article according to claim 49, wherein said yarn is greater than about 10 denier.

52. The knitted article according to claim 51, wherein said yarn is a 20/7.

53. The knitted article according to claim 51, wherein said yarn is about 40 denier.

54. The knitted article according to claim 53, wherein said yarn is a 40/13.

55. The knitted article according to claim 41, wherein said knitted article is formed from at least 2 ends.

56. The knitted article according to claim 55, wherein said knitted article is formed from at least 4 ends.

57. The knitted article according to claim 41, wherein said knitted article further includes leg portions.

58. The knitted article according to claim 57, wherein said knitted article further includes a panty.

59. The knitted article according to claim 41, wherein said at least one yarn end different from the yarn forming said top portion is functionally different.

60. The knitted article according to claim 59, wherein said different yarn is hydrophilic.

61. The knitted article according to claim 60, wherein said hydrophilic yarn is cotton.

62. The knitted article according to claim 61, wherein said cotton yarn is a 50/1.

63. The knitted article according to claim 59, wherein said different yarn is moisture transporting.

64. The knitted article according to claim 63, wherein said moisture transporting yarn is any one of olefin based, polyethylene oxide based, and polyester based.

65. The knitted article according to claim 64, wherein said moisture transporting yarn is 040/020 polypropylene based yarn.

66. The knitted article according to claim 41, wherein the yarn to yarn ratio between said at least one yarn end different from the yarn forming said top portion is between about 20/80 and 80/20.

67. The knitted article according to claim 66, wherein the yarn to yarn ratio is between about 40/60 and 60/40.

68. The knitted article according to claim 67, wherein the yarn to yarn ratio is about 50/50.

69. The knitted article according to claim 41, wherein about one yarn out of three is different.

70. The knitted article according to claim 41, wherein about two yarns out of three are different.

71. The knitted article according to claim 41, wherein about two yarns out of four are different.

72. The knitted article according to claim 41, wherein about three yarns out of four are different.

73. The knitted article according to claim 41, wherein said at least one yarn end different from the yarn forming said top portion is finished with the same color.

74. The knitted article according to claim 41, wherein at least one yarn end different from the yarn forming said top portion is finished with different colors.

75. The knitted article according to claim 41, wherein said lock stitch is a one-by-one alternating stitch.

76. The knitted article according to claim 41, wherein the sides and sole of said knitted article are substantially hidden when worn with footwear.

77. The knitted article according to claim 41, further including a transition zone between said top portion and said bottom portion.

78. The knitted article according to claim 77, wherein said transition zone is formed from the same yarn as the top portion.

79. A method for knitting an article, said method comprising the steps of:

(a) knitting a top portion at a cross stretch less than about 12;

(b) knitting a bottom portion at a cross stretch greater than about 12 while at the same time having at least one yarn end different from the yarn forming said top portion; and (c) sewing a seam extending substantially from the toe of said bottom portion to the heel of said bottom portion, thereby forming the sides and sole of said knitted article.

80. A method for knitting an article, said method comprising the steps of:

(a) knitting a top portion at a cross stretch less than about 12;

(b) knitting a bottom portion from a lock stitch at a cross stretch greater than about 12 while at the same time having at least one yarn end different from the yarn forming said top portion; and (c) sewing a seam extending substantially from the toe of said bottom portion to the heel of said bottom portion, thereby forming the sides and sole of said knitted article.

81. A method for knitting an article, said method comprising the steps of:

(a) knitting a top portion at a cross stretch less than about 12;

(b) knitting a bottom portion from a lock stitch at a cross stretch greater than about 12 while at the same time having at least one yarn end different from the yarn forming said top portion;

(c) sewing a seam extending substantially from the toe of said bottom portion to the heel of said bottom portion, thereby forming the sides and sole of said knitted article; and (d) proving an insert board for forming a package.

* * * * *

UNITED STATES PATENT AND TRADEMARK OFFICE

CERTIFICATE OF CORRECTION

PATENT NO. : 6,735,988 B1
DATED : May 18, 2004
INVENTOR(S) : Honeycutt

It is certified that error appears in the above-identified patent and that said Letters Patent is hereby corrected as shown below:

Column 2,
Line 23, “heal” should be -- heel --

Column 10,
Line 42, “proving” should be -- providing --.

Signed and Sealed this

Twenty-eighth Day of September, 2004

JON W. DUDAS
*Director of the United States Patent and Trademark Office*